US006095779A

United States Patent [19]

Nieman et al.

[11] Patent Number: 6,095,779

[45] Date of Patent: Aug. 1, 2000

[54] COMPRESSOR RING ATTACHMENT

[75] Inventors: Thomas John Nieman, Livonia; Vinh Hiep Luong, Westland; Eric William Scarlett, South Lyon, all of Mich.

[73] Assignee: Ford Motor Company, Dearborn, Mich.

[21] Appl. No.: 09/209,846

[22] Filed: Dec. 11, 1998

[51] Int. Cl.[7] ..... F01C 1/02

[52] U.S. Cl. ..... 418/55.3; 464/103; 29/888.022

[58] Field of Search ..... 418/55.3; 464/103; 29/888.02

[56] References Cited

U.S. PATENT DOCUMENTS

| | | | |
|---|---|---|---|
| 4,340,339 | 7/1982 | Hiraga et al. . | |
| 4,432,708 | 2/1984 | Hiraga et al. . | |
| 4,548,556 | 10/1985 | Terauchi . | |
| 5,423,663 | 6/1995 | Fukui | 418/55.3 |
| 5,513,968 | 5/1996 | Ochiai | 418/55.3 |

FOREIGN PATENT DOCUMENTS

| | | | |
|---|---|---|---|
| 0060495 | 9/1982 | European Pat. Off. | 418/55.3 |
| 1-138388 | 5/1989 | Japan . | |
| 405087063 | 4/1993 | Japan | 418/55.3 |

*Primary Examiner*—Thomas Denion
*Assistant Examiner*—Theresa Trieu
*Attorney, Agent, or Firm*—Raymond L. Coppiellie

[57] ABSTRACT

A scroll compressor includes a compressor housing and an orbiting scroll member, and includes an annular plate between the housing and orbiting scroll member. The plate has an axial aperture provided therethrough, the plate abuts one of the housing and orbiting scroll member. A pin projects through the aperture of the plate and is engaged with the member abutting the plate. A projection is provided on the ring, housing or orbiting scroll member for preventing axial displacement of the pin relative to the plate axially away from the abutting member.

18 Claims, 3 Drawing Sheets

COMPRESSOR RING ATTACHMENT

FIELD OF INVENTION

The present invention relates to a method and apparatus for attaching an annular ring, particularly in a scroll-type compressor.

BACKGROUND OF THE INVENTION

In a scroll-type compressor of the prior art, as illustrated in FIGS. 1 and 2, a pin is provided to secure and locate a coupling ring to an adjacent part such as the scroll assembly or the compressor housing. In a typical prior art compressor, the pin comprises a roll pin or a solid pin which is press fit into both the coupling ring and the adjacent part. A through hole is provided in the coupling ring having an interference fit to the roll pin. The adjacent part (the scroll or housing) has a similar undersize hole to form an interference fit with the roll pin.

In one prior art application, the pin is approximately 4 mm in diameter having approximately a 0.2 mm nominal interference fit to the hole provided in each of the components. Because of manufacturing tolerances, this interference fit may vary from 0 mm to 0.4 mm under normal conditions. However, excessive variation may result in a noninterference fit. Further, with larger interference fits, a large force is required for assembly. Typically, the coupling ring is made from steel and the pin is press-fit into the coupling ring. The coupling ring, having the pins installed, is then aligned to the adjacent part (either the scroll or housing, which may be made of aluminum), and the pin is then press-fit into the adjacent part. In the situation where a minimal interference fit is provided, the pin may become loose while the compressor is operating. In such an instance, the compressor may be damaged.

U.S. Pat. No. 4,340,339 discloses a second technique to rotationally engage a coupling ring to an adjoining component. Projections are provided on the coupling ring and radial slots are provided in the adjoining member. This technique is difficult and expensive to produce.

It would be desirable to provide a coupling ring assembly which is inexpensive and less sensitive to variation and which provides a secure retention of the pin.

SUMMARY OF THE INVENTION

In accordance with the objects of this invention, an air conditioning compressor is provided with an improved pin for attaching the coupling ring to an adjacent part. A scroll compressor includes a compressor housing and an orbiting scroll member, and includes an annular plate between the housing and orbiting scroll member. The plate has an axial aperture provided therethrough, the plate abuts one of the housing and orbiting scroll member. A pin projects through the aperture of the plate and is engaged with the member abutting the plate. A projection is provided on the ring, housing or orbiting scroll member for preventing axial displacement of the pin relative to the plate axially away from the abutting member. The pin is thereby prevented from becoming dislodged and damaging the compressor. The pin also accommodates the design which is less sensitive to variation in manufacturing.

DETAILED DESCRIPTION OF PREFERRED EMBODIMENTS

Figure 1:
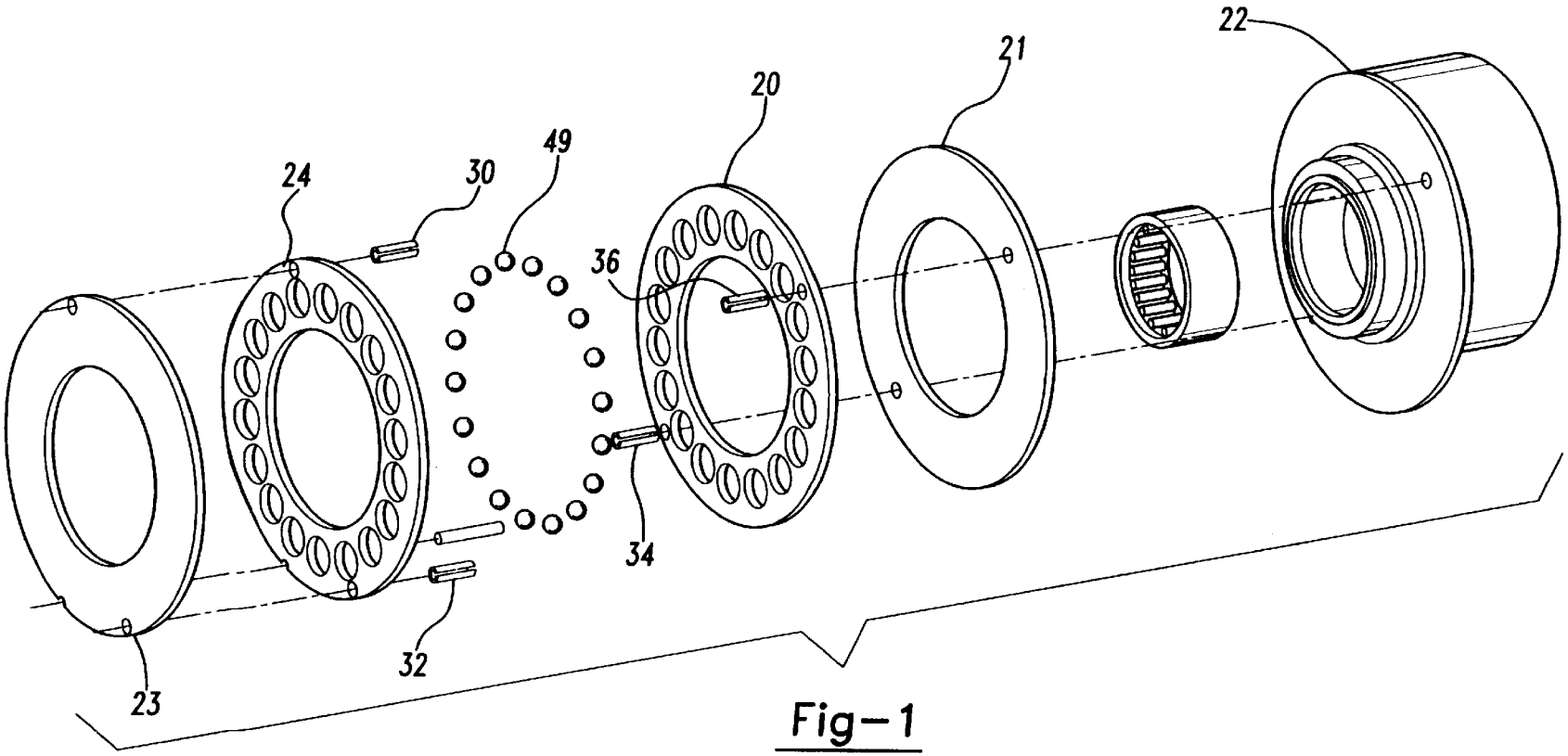
Fig-1 PRIOR ART
FIG. 1 is an exploded view of a coupling ring being assembled to an orbiting scroll of the prior art.
Figure 2:
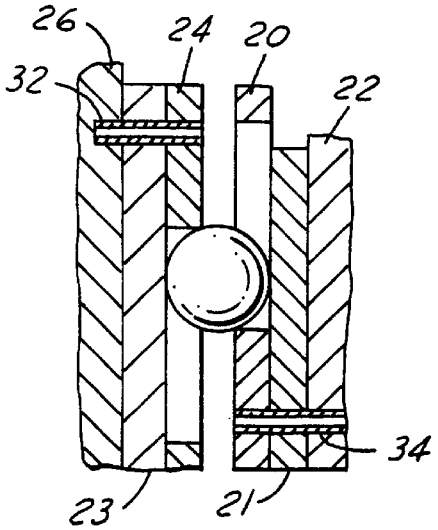
FIG. 2 PRIOR ART
FIG. 2 is a partial sectional view through the assembly of FIG. 1 to illustrate a prior art attachment pin.

As shown in FIGS. 1–2, in scroll compressors of the prior art, a ball coupling ring 20 is provided adjacent an orbiting scroll assembly 22 and a second ball coupling ring 24 is provided adjacent a housing 26. These ball coupling rings 20, 24 are fixed to adjacent members 22, 26 using a press-fit pin 30, 32, 34, 36. As shown in prior art FIG. 2, a first plate 24 is fixed to the housing 26 using a pair of pins 30, 32. A second pair of pins 34, 36 hold a second plate 20 to the orbiting spiral assembly 22. The pins 30, 32, 34, 36 are press-fit into the plates 20, 24. The plate and pin assemblies are then press-fit into the housing 26 and scroll 22. As described in the Background section, during operation of the compressor, a prior art pin may work loose and damage the unit. A roll pin is frequently used in this application, or a solid cylindrical pin may likewise be used. These pins may hold other components, such as an intermediate member 21, 23. These members 21, 23 may comprise shims, wear plates, or other components.

The interference fit of the pins 30, 32, 34, 36 provides for alignment of the components as well as retention of the pins during operation under most conditions. Such an assembly is disclosed in U.S. Pat. No. 4,548,556, to Terauchi, which is incorporated herein by reference.

Applicant has recognized that the steel balls 49 exert an axially outward force on the coupling rings 20, 24. Therefore, applicant has recognized that the interference fit between the pins 30, 32, 34, 36 the rings 20, 24 is most beneficial for alignment and less necessary for axial retention of the plates 20, 24 to the adjacent part 22, 26.

Applicant therefore proposes herein an improved retention system of a coupling ring to an adjacent part. In my copending U.S. application Ser. No. 08/996,775, which is incorporated herein by reference, a projection is provided on a pin to retain the pin. I have improved this by moving the retention feature from the pin to the coupling ring.

Figure 3:
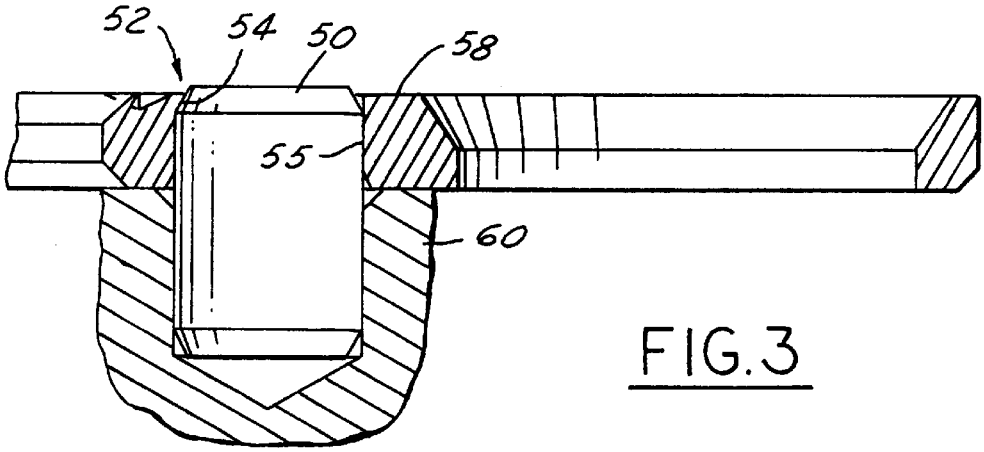
FIGS. 3–8 are partial views through attachment pins according to various embodiments of the present invention.
Figure 4:
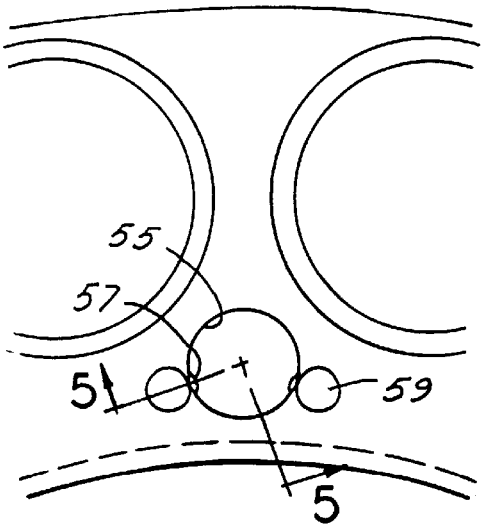
Figure 5:
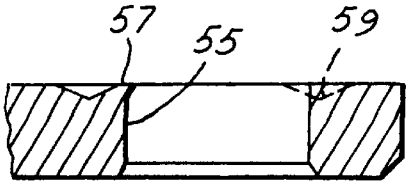

As illustrated in FIG. 3, this retention is accomplished by providing a pin 50 in a part, such as an orbiting scroll 60. A coupling member, such as an orbiting ring 58, has a hole 55 provided therein fit over the pin 50. An axial retention means 52 is formed in the ring 58 in one of several manners. A preferred embodiment is illustrated in FIGS. 3–5, where the hole 55 has one or more indentations 57, 59 coined in to the upper surface of the ring 58, thereby deforming material radially into the hole 55 and thereby axially retaining the pin 50 with respect to the ring 58. In the embodiment shown in FIG. 3, the pin 50 includes a chamfer 54 at the end thereof for engagement with the indentations 57, 59. Alternatively, one skilled in the art could retain a pin having a squared end engaged with the material deformed into the hole 55 by the indentations 57, 59. Furthermore, one skilled in the art appreciates that a radius or even a straight top pin could be used in this application; likewise, a chamfered top pin could be used. The hole could also be a blind hole. In an alternative embodiment, the pin 50 includes an annular groove or key slot at an axial position corresponding with the top of the scroll 60 and the hole in the scroll 60 is coined to form a similar indentation (not shown) to retain the pin axially. A similar groove (not shown) may be provided in the pin 50 adjacent the top or bottom surface of the ring 58 and the ring may be coined at this location to retain the pin 50 axially in a manner similar to that described above.

Figure 6:
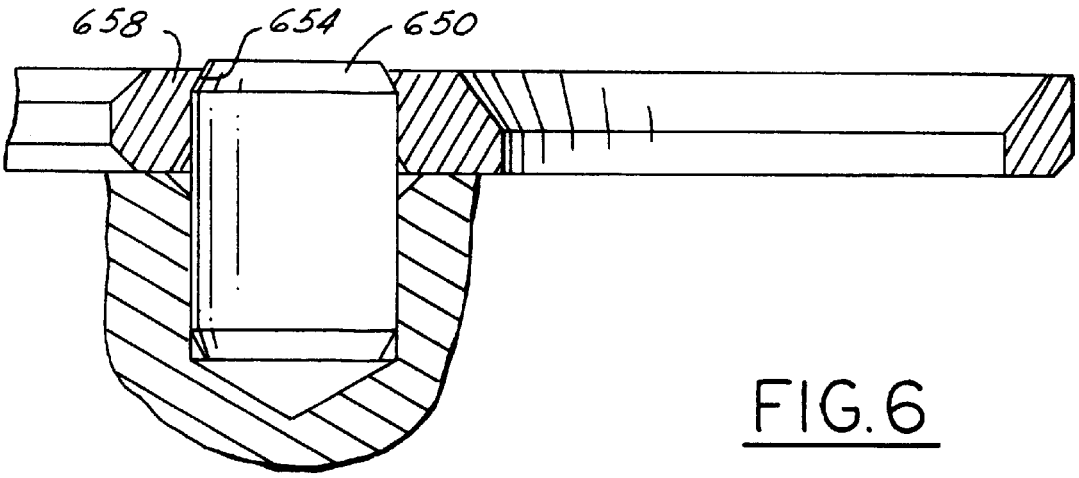
Figure 7:
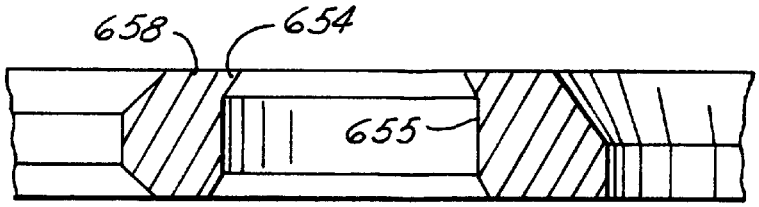
Figure 8:
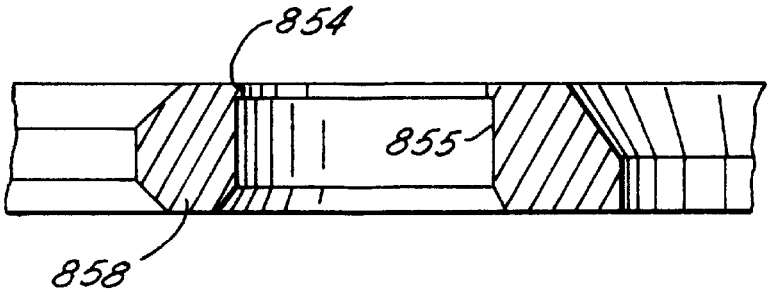

In further alternative embodiments, as illustrated in FIGS. 6–8, a circumferential land 654, 854, respectively, is formed in the ring 658, 858 to axially retain the pin in a manner similar to that described above with reference to the indentations 57, 59. One skilled in the art appreciates the land 654, 854 illustrated herein are representative of the shape of such a land and not limited thereto. Further, although the lands 654, 854 are preferably circumferential for machining operations, one skilled in the art appreciates the land 654, 684 does not necessarily extend about the entire circumference of the hole to adequately retain the pin.

In a further alternative embodiment, an annular groove (not shown) is provided in the inside diameter 55 of the ring 58 and a snap ring (not shown) is provided therein to axially retain the pin 50. One skilled in the art appreciates many other similar means of retaining the pin may be employed to project from the ring 58 or scroll 60 to retain the pin 50.

A further advantage of the present invention is that the current invention permits a smaller interference fit using the same hole manufacturing tolerances. In a preferred embodiment, the fit ranges from a zero interference, or line-to-line fit, to approximately a 0.2 mm interference fit (versus the prior art interference of 0.2 mm to 0.4 mm) for an approximately 6 mm pin. As a further cost reduction, the tolerances may be relaxed to allow a fit of 0 mm to 0.4 mm in an alternative embodiment, keeping the same maximum insertion forces as the prior art installation.

Figure 9:
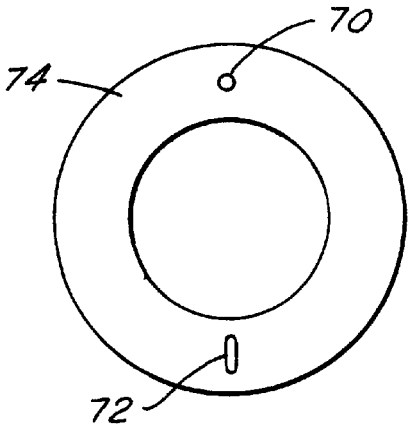
FIG. 9 is a schematic plan view of a ring according to an embodiment of the present invention.

In a further alternative embodiment, as illustrated in FIG. 9, a first hole 70 is provided in the coupling ring 74 in a manner similar to the holes of FIGS. 3–8. The first hole 70 is sized to fit the pin (not shown in FIG. 9) radially and circumferentially as described above with reference to FIGS. 3–8, and one of the retainers described therein is used to axially retain the pin. A second hole 72 is provided in the coupling ring 74 is slotted radially as shown. Thus, a pin (not shown in FIG. 9) engages the first hole 70 to locate the coupling ring radially as well as circumferentially. A second pin (not shown in FIG. 9) engages the second hole 72 and only locates the plate 74 circumferentially. Therefore, any variation between the parts is more easily accommodated with lower assembly forces. The slotted hole 72 includes a means to axially retain the pin (not shown) as described above, such as coining or a land.

It is to be understood that the embodiments of the invention described above are merely illustrative of application of principles of the present invention. Numerous modifications may be made to the methods and apparatus described above without departing from the true spirit and scope of the invention.

What is claimed is:

1. A scroll compressor having a compressor housing and an orbiting scroll member, comprising:

an annular plate provided between the housing and orbiting scroll member, the plate having an axial aperture provided therethrough, the plate abutting one of said housing and said orbiting scroll member;

a pin projecting through the aperture of the plate and engaged at a first end thereof with the member abutting the plate; and a radial projection provided on one of the plate and member, the projection engaged with the pin for preventing axial displacement of said pin relative to said plate axially away from the abutting member.

2. A scroll compressor according to claim 1, wherein the projection comprises a radial projection formed in the plate projecting into the aperture and engaged with a second end of the pin.

3. A scroll compressor according to claim 2, wherein the pin comprises a chamfer at the second end thereof for engagement with the projection.

4. A scroll compressor according to claim 2, wherein the projection comprises material displaced into the aperture while an indentation is coined in the plate adjacent the aperture.

5. A scroll compressor according to claim 2, wherein the projection comprises a land formed in the aperture when the aperture is formed in the plate.

6. A scroll compressor according to claim 5, wherein the pin comprises a chamfer at the second end thereof for engagement with the projection.

7. A scroll compressor according to claim 5, wherein the land has a substantially rectangular cross section and extends circumferentially about the aperture.

8. A method of attaching an annular ring in a scroll compressor having a compressor housing and an orbiting scroll member, the method comprising:

providing an axial aperture through the annular ring;

abutting the ring against one of said housing and said orbiting scroll member;

projecting a pin through the aperture of the plate and engaging the pin with the member abutting the ring; and providing a projection on one of the ring, housing and orbiting scroll member for engagement with the pin for preventing axial displacement of said pin relative to said plate axially away from the abutting member.

9. A method according to claim 8, further comprising inserting a first end of the pin through the ring and into one of the orbiting scroll member and housing, then coining the ring to deform material to form the projection.

10. A method according to claim 8, further comprising the steps of:

locating the ring axially and radially relative to the abutting member with the first pin and aperture;

providing a second aperture through the ring, the second aperture being axially slotted; and locating the ring relative to the abutting member with a second pin and the second aperture.

11. A scroll compressor having a compressor housing and an orbiting scroll member, comprising:

an coupling ring provided between the housing and orbiting scroll member, the ring having an axial aperture provided therethrough, the ring abutting one of said housing and said orbiting scroll member;

a pin projecting through the aperture of the ring having a press fit with the ring and the member abutting the ring; and a projection provided on the ring for preventing axial displacement of said pin relative to said ring axially away from the abutting member.

12. A scroll compressor according to claim 11, wherein the projection comprises material displaced by an indentation formed in the ring adjacent the aperture.

13. A scroll compressor according to claim 11, wherein the projection comprises a land formed in the aperture.

14. A scroll compressor according to claim 13, wherein the land comprises an annular land provided about the circumference of the aperture.

15. A scroll compressor according to claim 14, wherein the land is integrally formed.

16. A scroll compressor according to claim 11, further comprising the ring having a second aperture formed therethrough for a second pin, the second aperture being radially slotted.

17. A scroll compressor according to claim 16, wherein the projection comprises material displaced by an indentation formed in the ring adjacent each of the apertures.

18. A scroll compressor according to claim 16, wherein the projection comprises a land formed in each of the apertures.

* * * * *